United States Patent [19]

Parsons

[11] Patent Number: 4,924,824

[45] Date of Patent: May 15, 1990

[54] TWO STROKE ENGINES

[75] Inventor: Bryan N. V. Parsons, Stoney Stanton, England

[73] Assignee: Jaguar Cars Limited, United Kingdom

[21] Appl. No.: 372,284

[22] Filed: Jun. 27, 1989

[30] Foreign Application Priority Data

Jul. 1, 1988 [GB] United Kingdom ..... 8815696

[51] Int. Cl.[5] ..... F02F 3/28

[52] U.S. Cl. ..... 123/65 P; 123/193 P; 123/56 BC; 123/197 AC

[58] Field of Search ..... 123/65 P, 56 BC, 55 R, 123/193 P, 197 AC; 92/261, 172

[56] References Cited

U.S. PATENT DOCUMENTS

| | | | |
|---|---|---|---|
| 915,828 | 3/1909 | Cameron | 123/56 BC |
| 4,142,500 | 3/1979 | Davis . | |
| 4,337,734 | 7/1982 | Iio | 123/65 P |
| 4,516,540 | 5/1985 | Nerstrom | 123/65 P |
| 4,765,292 | 8/1988 | Morgado | 123/193 P |
| 4,829,954 | 5/1989 | Morgado | 123/193 P |

FOREIGN PATENT DOCUMENTS

| | | |
|---|---|---|
| 1316775 | 6/1970 | United Kingdom . |
| 1388904 | 3/1972 | United Kingdom . |

*Primary Examiner*—Willis R. Wolfe
*Assistant Examiner*—M. Macy
*Attorney, Agent, or Firm*—Davis, Bujold & Streck

[57] ABSTRACT

A two stroke engine has a closed plane cylinder with an inlet port and outlet port disposed on opposite sides of the cylinder towards the open end thereof. A piston is slidingly sealed in the cylinder the piston having a head portion which is slidingly sealed with the wall of the cylinder and a connecting rod portion which extends axially from the head portion. The end of the connecting rod portion remote from the head portion is connected to a crank on a crankshaft, the ports being disposed one on each side of the vertical axial plane of the crankshaft so that; upon downward movement the piston will tilt, opening the exhaust port before the inlet port and; upon upward movement the piston will tilt closing the exhaust port before the inlet port, the throw of the crank producing a maximum piston tilt of up to 10°. A multi-cylinder engine may comprise a plurality of piston/cylinder assemblies described above, disposed radially of one another about a common crankshaft.

26 Claims, 2 Drawing Sheets

TWO STROKE ENGINES

BACKGROUND TO THE INVENTION

The present invention relates to two stroke engines.

SUMMARY OF THE INVENTION

According to one aspect of the present invention, a two stroke engine comprises a closed plane cylinder with an inlet and an exhaust port disposed on opposite sides of the cylinder towards the open end thereof, a piston slidable in the cylinder, said piston comprising a head portion which is slidingly sealed in the cylinder and a connecting rod portion which extends axially from the head portion, the end of the connecting rod portion remote from the head portion being connected to a crank on a crankshaft, the ports being disposed one on each side of the vertical axial plane of the crankshaft so that; upon downward movement the piston will tilt, opening the exhaust port before the inlet port and; upon upward movement the piston will tilt, closing the exhaust port before the inlet port, the throw of the crank producing a maximum piston tilt of up to 10°.

Tilting of the piston in the engine described above, will allow the exhaust port to open first on the downstroke so that upon subsequent opening of the inlet port, a scavenging charge may be introduced into the cylinder. On the upstroke, the exhaust port will close first so that the air charge may be introduced into the cylinder through the inlet port after the exhaust port is closed.

Fuel is preferably injected into the cylinder as the piston moves towards top dead centre. According to a preferred embodiment the top of the piston is radiussed so that as it approaches top dead centre and the tilt changes from one direction to the other, it will roll against the head of the cylinder swashing the fuel from one side of the cylinder to the other to improve mixing of the fuel charge with the air charge.

The head portion of the piston is slidingly located and sealed with respect to the cylinder by means of a piston ring. In order to permit tilting of the piston in the cylinder, the piston head is relatively thin and is relieved on either side of the piston ring. The piston ring will accommodate the increase in clearance between the piston and cylinder as the piston is tilted. Preferably, the throw of the crank is such as to produce a maximum tilt of up to 10° and more preferably a maximum tilt of from 5° to 7°.

In order to prevent interconnection of the exhaust port and inlet port on the rearside of the piston, a skirt formation which is slidingly located within the cylinder is pivotally attached to the rearside of the piston so that as the head of the piston moves past the inlet and exhaust ports, the skirt will close one or both ports. Advantageously, the skirt may be divided into two semicircular shells each pivotted to the piston head at the portions thereof which pass over the exhaust and inlet ports.

For lubrication purposes, the crankshaft and connection with the connecting rod portion of the piston may be enclosed in a box formation which is mounted for rotation on the crankshaft on a crank having a throw sufficient to accommodate tilting of the piston. The connecting rod portion passes through an aperture in the box, extensible sealing means, for example an elastomeric ring being provided between the aperture of the box and the connecting rod to accommodate the small changes in dimension which will occur on tilting of the connecting rod portion.

Preferably, a plurality of cylinder/piston assemblies as described above, are disposed radially with respect to one another the connecting rod portions of the pistons being connected to a common crank on the crankshaft.

BRIEF DESCRIPTION OF THE DRAWINGS

Various embodiments of the invention are now described, by way of example only, with reference to the accompanying drawings, in which;

FIG. 4 illustrates a four cylinder two stroke engine based on the single cylinder engine illustrated in FIG. 1; and FIG. 5 illustrates a modified four cylinder two stroke engine.

DESCRIPTION OF A PREFERRED EMBODIMENT

Figure 1:
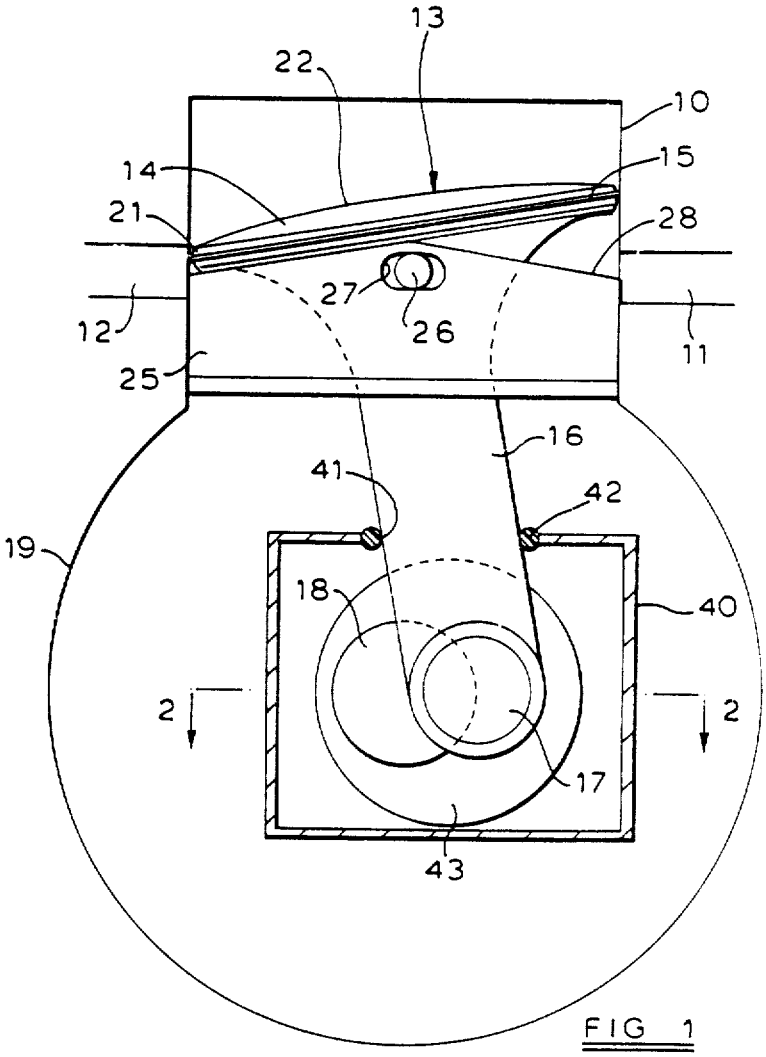
FIG. 1 illustrates a single cylinder two stroke engine in accordance with the present invention.
Figure 2:
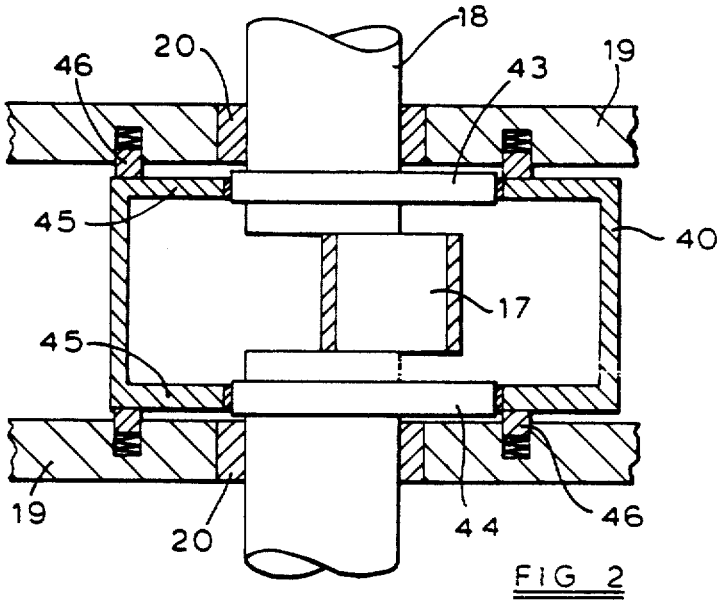
FIG. 2 is a section along the line 2—2 of FIG. 1.

As illustrated in FIG. 1, a two stroke engine comprises a closed cylinder 10 with inlet port 11 and exhaust port 12. A piston 13 is slidingly located in the cylinder 10, a head portion 14 of the piston 13 being sealed with respect to the walls of the cylinder 10 by means of a piston ring 15.

The piston 13 has a connecting rod portion 16 formed integrally of the head portion 14 and extending coaxially thereof. The end of the connecting rod portion 16 is connected to the crank 17 of a crankshaft 18 which is rotatively mounted with respect to a crankcase 19 in bearings 20. The piston 13 is thereby constrained by the cranshaft 18 to move in reciprocating motion within the cylinder 10, the piston 13 being tilted in one direction (as illustrated in FIG. 1) upon downward movement and in the opposite direction upon upward movement. In this manner, upon downward movement of the piston 13 the exhaust port 12 is opened before the inlet port 11 and upon upward movement, the exhaust port 12 will be closed before the inlet port 11.

Consequently upon the downward power stroke of the piston 13, the exhaust port 12 will open first followed by the inlet port 11 through which a scavenging air charge may be introduced into the cylinder 10. On the upward compression stroke of the piston 13, the exhaust port 12 will close first so that the air charge may be introduced into the cylinder through the inlet port 11 while the exhaust port 12 is closed.

In order to accommodate tilting of the piston 13 in cylinder 10, the head portion 14 has a narrow outer peripheral portion 20 the edge 21 thereof being relieved on either side of piston ring 15. The top 22 of the head portion 14 of the piston 13 is radiussed so that as the piston 13 moves through top dead centre and the direction of tilt changes, the top 22 of the piston 13 will roll across the head of the cylinder 10 swashing the compressed charge in the cylinder from one side to the other, thus improving mixing of the charge. Means (not shown) is provided for injection of fuel into the cylinder 10 as the piston 13 approaches top dead centre. This means need only provide low pressure injection, as the charge will subsequently be mixed by the swashing action of the piston 13.

Upon tilting of the piston 13, the clearance between the edge 21 and the cylinder wall on the diameter transverse to the axis of the crank shaft, will increase. This increase in clearance must be accommodated by the piston ring 15. The angle of tilt must consequently be restricted and preferably the major axis of the ellipse defined by the plane of the piston head portion cutting the cylinder at the maximum angle of tilt will be no more than 1.5% greater than the bore of the cylinder.

The increase in clearance will depend upon the maximum angle of tilt of the piston 13 and the diameter of the piston head 14, while the angle of tilt will depend upon the stroke of the piston 13 and the distance between the piston ring 15 and centre of crank 17, the latter depending upon the length of the connecting rod portion 16 of piston 13. A typical engine of 127 cc capacity, the bore may be 90 mm, the stroke 20 mm and the distance from the piston ring 15 to the centre of crank 17, 76 mm. This engine configuration will give a maximum angle of tilt of the order of 7.5° and a variation in clearance on both sides of the cylinder head 14 of 0.4 mm. This change in clearance will easily be accommodated by the piston ring 15.

A cylindrical skirt formation 25 which slidingly engages the walls of cylinder 10 is pivotally attached to the rearside of the piston head 14 by means of a pair of pins 26, the pins 26 extending radially from the piston head 14 on a diameter parallel to the axis of rotation of crank shaft 18, and being located as close as possible to the piston ring 15. The pins 26 locate in elongate holes 27 in the skirt formation 25 in order to allow for lateral movement of the pins 26 upon tilting of the piston 13. The upper edges 28 of the skirt formation 25 are cut away to provide a clearance for the head portion 14 of the piston 13, as it is tilted.

Figure 3:
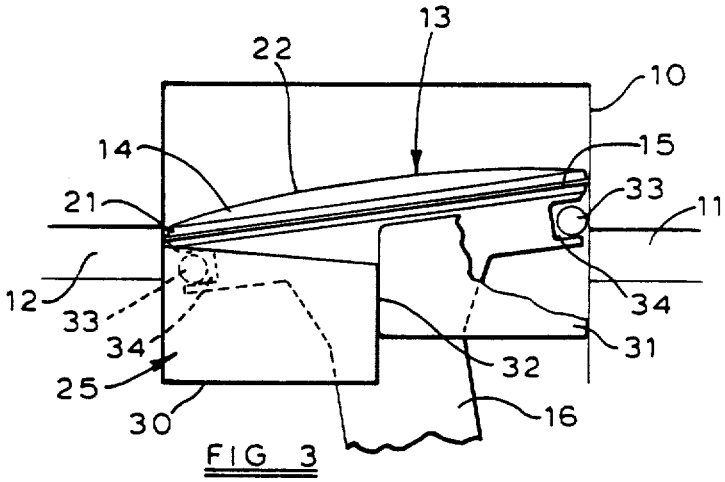
FIG. 3 illustrates a modification to the engine illustrated in FIG. 1.

The skirt formation 25 serves to close the inlet port 11 and outlet port 12 on the rearside of the piston 13 after the head portion 14 has passed the ports. As illustrated in FIG. 1, because of tilting of the piston 13 and the cutaway edges 28, sealing by the skirt formation 25 is only partially efficient on the side of the piston 13 tilted towards the closed end of the cylinder 10. Complete sealing of both ports may be achieved as illustrated in FIG. 3. In this embodiment, the cylindrical skirt 25 is divided into two semi cylindrical shells 30 and 31 which are slidingly located in the cylinder 10 making sliding engagement with one another along edges 32. These shells 30 and 31 are pivotally attached to the piston head 14 by means of pins 33 which are mounted chordally of the shells 30 and 31 parallel to the axis of rotation of the crankshaft 18. The pins 33 engage in outwardly opening chordal grooves 34 in the edge of head portion 14 adjacent to pins 33, so that they can pivot and move laterally of the piston head 14 as the piston 13 tilts.

The crankshaft 18 is enclosed in a box structure 40, the connecting rod portion 16 of piston 13 extending through an aperture 41 in one wall of the box structure 40 and being sealed with respect thereto by sealing means 42. The sealing means 42 is for example an elastomeric sealing ring, which will permit axial movement of the connecting rod portion 16 and also tilting thereof.

The box structure 40 is mounted at either side of the crank 17 on a pair of cranks 43 and 44 which engage bearings in the end walls 45 of box structure 40. The cranks 42 and 43 are disposed in the same radial plane as crank 17, the throw being equal to the maximum displacement of the centre line of the connecting rod portion 16 of piston 13, where it passes through the aperture 41. The box structure 40 will thus move with the piston 13, so that the connecting rod portion 16 remains centrally of aperture 41. The end walls 45 of the box structure 40 are sealed to the end walls of crankcase 19 by, for example, face seals 46. The box structure 40 will enable the use of a wet lubrication system for the bottom end of the engine.

The four cylinder engine illustrated in FIG. 4 is based upon four cylinder 10/piston 13 assemblies, similar to those described above, arranged radially at 90° to one another.

The connecting rod portion 16 of all four pistons 13 are connected to the same crank 17. Sectoral bearing formations 60 provided on the end of each connecting rod portion 16 engaging an inner bearing surface 61 on the crank 17 and are located thereon by means of a pair of outer annular bearings 62 engaging axially extending portions of the bearing formations 60 on either side of the connecting rod portion 16. The bearing formations 60 extend angularly by less than 90°, so that gaps 64 are provided between the formations 60 and permit shuttling movement therebetween to allow for tilting of the pistons 13 in opposite directions.

The loads applied by the pistons 13 to the crank 17 are applied predominantly to the inner bearing surface 61, the outer annular bearings 62 being provided to take minor reaction forces and to retain the bearing formations 60 in position. The inner bearing surface 61 may be provided by the outer race of a roller bearing mounted on the crank 17 which will accommodate rotational movement between the crank 17 and the bearing formations 60, shuttling of the bearing formations 60 relative to the outer race occurring to allow for tilting of the pistons 13.

The crankcase 19 of the engine illustrated in FIG. 4 is divided into four compartments 71, 72, 73 and 74 by means of telescopic vanes 75 which extend the full width of the crankcase 19 from the wall of the crankcase 19 and are maintained in sliding engagement with the walls of the box structure 40 by spring means 76, so that as the box structure 40 moves with the crankshaft 18, the vanes 75 will maintain sealing engagement with the walls thereof. With this arrangement, as the pistons 13 move the volume of the compartments 71, 72, 73 and 74 will change and this change in volume may be used to pump air to the cylinders 10*a*, 10*b*, 10*c* and 10*d*.

The chambers 71, 72, 73 and 74 associated with each of the cylinders 10*a*, 10*b*, 10*c* and 10*d* are connected to the inlet port of the following cylinder 10*d*, 10*a*, 10*b*, and 10*c* respectively. The pistons 13*a*, 13*b*, 13*c* and 13*d* in each of the cylinders 10*a*, 10*b*, 10*c* and 10*d* are 90° out of phase with that of the following cylinder 10*b*, 10*c*, 10*d*, and 10*a* respectively.

Consider for example cylinder 10*b*. As the piston 13*b* approaches bottom dead centre, the next piston 13*c* will be moving down from top dead centre and chamber 73 will be reducing in volume. As soon as the inlet port 11 of cylinder 10*b* is exposed by the piston 13*b*, air under pressure will be supplied from chamber 73 which will at first scavenge the exhaust gases from cylinder 10*b*. The piston 13*c* will continue to move downwardly after piston 13*b* has passed bottom dead centre and will continue to pump air to cylinder 10*b* until the inlet port 11 thereof is closed by the piston 13*b*. Air inlets (not shown) are provided to each of the chambers 71, 72, 73 and 74. These air inlets may be controlled by pressure valves so that when the piston 13*c* moves from bottom dead centre toward top dead centre and chamber 73 is expanding, air will be drawn into the chamber 73. The air inlets to the chambers may alternatively be associated with the sealing means 46 between the box structure 40 and the end walls of the crankcase 19, so that they will be closed as the chambers 71, 72, 73 or 74 are reducing in volume and open when the chambers 71, 72, 73 or 74 are increasing in volume.

In the embodiment illustrated in FIG. 5, in place of the telescopic vanes 75, the crankcase 19 is divided into compartments 80, 81, 82 and 83 by four vanes 84 extending between the end walls of the crankcase 19 parallel to the crankshaft 18. The vanes 84 terminate in a formation 85 of circular cross section. The formations 85 engage in grooves 86 in the box formation 40, the grooves 86 being contoured so that the formations 85 make sealing engagement therewith during a substantial part of movement of the box structure 40 but move out of sealing engagement to permit connection of the chamber associated with one cylinder with another chamber, for example as illustrated in FIG. 5, as the piston 13*b* begins to move upwardly from bottom dead centre, chamber 81 is connected to chamber 82.

Each of the cylinders 10*a*, 10*b*, 10*c* and 10*d* are interconnected with the chamber 80, 81, 82 and 83 respectively defined on the rear side of the piston 13*a*, 13*b*, 13*c* and 13*d*, (respectively) by means of a transfer port 87. In this embodiment, one semi cylindrical shell 30 is provided on one side of the piston 13*a*, 13*b*, 13*c* and 13*d* to close the exhaust port 12 on the rear side of the piston. Spring means (not shown) is provided between the piston 13 and the shell 30 to maintain the shell 30 in engagement with the cylinder wall. An air inlet port 88 is provided below the exhaust port 12 so that it will be controlled by the shell 30, opening as the piston 13*a*, 13*b*, 13*c* or 13*d* moves towards top dead centre and allowing air to enter the expanding chamber 80, 81, 82 or 83 respectively on the rear side of the piston.

In this embodiment, the air charge to any cylinder, for example cylinder 10*b*, will initially be provided by downward movement of the piston 13*b* associated with that cylinder but will be augmented by air under pressure from the chamber 82 associated with the next cylinder 10*c*, as the piston 13*b* moves upwardly from bottom dead centre.

In order to keep the angle of tilt down to the preferred range the present invention will typically provide an engine of relatively large bore and short stroke, this will be particularly suitable for diesel engines.

I claim:

1. A two stroke engine comprising a closed plane cylinder with an inlet and an exhaust port disposed on opposite sides of the cylinder towards the open end thereof, a piston slidable in the cylinder, said piston comprising a head portion which is slidingly sealed in the cylinder and a connecting rod portion which extends axially from the head portion, the end of the connecting rod portion remote from the head portion being connected to a crank on a crankshaft, the ports being disposed one on each side of the vertical axial plane of the crankshaft so that; upon downward movement the piston will tilt, opening the exhaust port before the inlet port and; upon upward movement the piston will tilt closing the exhaust port before the inlet port, the throw of the crank producing a maximum piston tilt of up to 10°.

2. A two stroke engine according to claim 1 in which the top of the piston is radiussed so that it will roll across the head of the cylinder, as the piston moves through top dead centre and the tilt of the piston changes from one direction to the other.

3. A two stroke engine according to claim 1 in which the head of the piston has a thin peripheral portion, a piston ring being located in a groove in the edge of this peripheral portion, the edge being relieved on either side of the piston ring, to accommodate tilting of the piston.

4. A two stroke engine according to claim 1 in which the throw of the crank will produce a maximum piston tilt of from 5° to 7°.

5. A two stroke engine according to claim 1 in which the bore of the cylinder and the throw of the crank are dimensioned such that the major axis of the ellipse defined by the plane of the piston head portion cutting the cylinder at maximum angle of tilt will be no more than 1.5% greater than the bore of the cylinder.

6. A two stroke engine according to claim 1 in which a skirt formation which engages the cylinder wall, is pivotally attached to the piston on the rear side of the head portion, so that it will close one or both of the inlet and exhaust ports when the piston is disposed on the cylinder head side of the ports.

7. A two stroke engine according to claim 6 in which the skirt formation is in the form of a cylindrical sleeve which slidingly engages the walls of the cylinder, the sleeve being pivotally attached to the piston on a pair of pins which extend radially from the piston on a diameter parallel to the axis of rotation of the crankshaft, the pins locating in holes in the sleeve, said holes being elongate transverse to the axis of the cylinder.

8. A two stroke engine according to claim 6 in which the skirt formation comprises a part cylindrical shell which engages the wall of the cylinder, the shell being pivotally attached to the piston by means of a pin mounted chordally of the shell and engaging a chordal groove in the head portion of the piston.

9. A two stroke engine according to claim 8 in which a pair of semi-cylindrical shells are pivotally attached to opposite sides of the piston, the longitudinal edges of one shell making sliding engagement with those of the other shell to maintain the shells in sliding engagement with the cylinder wall.

10. A two stroke engine according to claim 8 in which a part cylindrical shell is maintained in engagement with the cylinder wall by a spring means acting between the shell and the piston.

11. A two stroke engine according to claim 1 in which the crankshaft is enclosed within a box formation, the connecting rod portion of the piston passing through an aperture in one wall of the box formation, extensible sealing means being provided around the aperture to permit relative axial movement of the connecting rod formation and tilting of the piston.

12. A two stroke engine according to claim 11 in which the box formation is mounted on a pair of cranks on the crankshaft, the cranks being disposed on the same radial axial plane as the crank to which the piston is connected and having a throw which will maintain the aperture in the box formation centralised with the connecting rod formation of the piston, as the piston tilts.

13. A two stroke engine according to claim 11 in which the end walls of the box formation are sealed with respect to the crankcase.

14. A multi cylinder engine comprising two or more cylinder/piston assemblies as claimed in claim 1, said cylinder/piston assemblies being disposed radially with respect to one another about a common crankshaft.

15. A multi cylinder engine according to claim 14 in which all the pistons are connected to a common crank.

16. A multi cylinder engine according to claim 15 in which the ends of the connecting rod portions of the pistons remote from the head portions, are provided with sectoral bearing formations which are located between inner and outer bearing surfaces on the crank, gaps being provided between the sectoral bearing formations of adjacent pistons, to permit relative shuttling thereof to accommodate the tilting of the pistons.

17. A multi cylinder engine according to claim 16 in which the inner bearing surface of the crank is formed by the outer race of a roller bearing.

18. A multi cylinder engine according to claim 14 in which the crankshaft is enclosed in a box structure, vanes extending from the crankcase and engaging the box structure in order to divde the crankcase into several compartments, each compartment being associated with a different one of the pistons, so that during relative movement between the piston and box structure the volume of the compartments will vary.

19. A multi cylinder engine according to claim 18 in which the vanes are telescopic and spring loaded into sliding engagement with the walls of the box structure.

20. A multi cylinder engine according to claim 18 in which formations on the vanes sealingly engage complementary formations on the box structure.

21. A multi cylinder engine according to claim 18 in which the chamber associated with a first piston is connected to the inlet port of a cylinder associated with a second piston, so that as said inlet port of the cylinder associated with said second piston is opened, the chamber associated with said first piston will be reducing in volume and will deliver air into the cylinder associated with said second piston.

22. A multi cylinder engine according to claim 20 in which the cylinder associated with one piston is connected to the chamber associated with said piston by a transfer port, so that after said piston has opened the transfer port downward movement of said piston will force air into the cylinder, the formations on the vanes and the box structure permitting connection of said chamber with a second chamber when said piston has moved past bottom dead centre, so that air will be provided from said second chamber to augement that from the chamber associated with the said piston as said piston moves upwardly from bottom dead centre.

23. A multi cylinder engine according to claim 18 in which air inlets are provided to each of the chambers.

24. A multi cylinder engine according to claim 23 in which the air inlets are controlled by pressure valves so that they will be closed as the volume of the chamber reduces.

25. A multi cylinder engine according to claim 23 in which the air inlets are controlled by sealing means between the box structure and the crankcase.

26. A multi cylinder engine according to claim 23 in which the air inlets are controlled by a skirt formation associated with the piston.

* * * * *